United States Patent [19]

Honda et al.

[11] 4,355,884

[45] Oct. 26, 1982

[54] ELECTROPHOTOGRAPHIC APPARATUS

[75] Inventors: Haruhisa Honda; Tsutomu Toyono, both of Tokyo; Shunji Nakamura, Kawasaki; Kano Tanaka, Yokohama; Yoshimasa Kimura, Kawasaki, all of Japan

[73] Assignee: Canon Kabushiki Kaisha, Tokyo, Japan

[21] Appl. No.: 111,972

[22] Filed: Jan. 14, 1980

[30] Foreign Application Priority Data

Jan. 20, 1979 [JP] Japan ..... 54-5813
Jan. 20, 1979 [JP] Japan ..... 54-5814

[51] Int. Cl.[3] ..... G03G 15/00

[52] U.S. Cl. ..... 355/14 CH; 355/3 CH; 250/324; 361/235; 307/17

[58] Field of Search ..... 353/14 CH, 3 CH; 361/235; 250/324, 325, 326; 323/247, 255, 328, 340; 307/17, 24

[56] References Cited

U.S. PATENT DOCUMENTS

| | | | |
|---|---|---|---|
| 2,497,604 | 2/1950 | Henry et al. | 361/213 |
| 3,454,780 | 7/1969 | Cominassi et al. | 307/17 |
| 3,557,368 | 1/1971 | Tano | 250/324 |
| 4,136,942 | 1/1979 | Nakahata et al. | 355/3 CH |
| 4,144,463 | 3/1979 | Sugiura | 307/24 X |
| 4,239,373 | 12/1980 | Weikel, Jr. | 355/14 CH X |
| 4,248,524 | 2/1981 | Takahashi | 355/14 CH X |

FOREIGN PATENT DOCUMENTS

| | | | |
|---|---|---|---|
| 2805471 | 8/1978 | Fed. Rep. of Germany | 355/3 CH |
| 54-124994 | 9/1979 | Japan | 355/14 CH |

OTHER PUBLICATIONS

"Xerox Disclosure Journal" vol. 4, No. 5, Sep./Oct. 1979, p. 603, Controlling the Output of Corona Devices–Clark et al.

*Primary Examiner*—J. B. Truhe
*Assistant Examiner*—Richard M. Moose
*Attorney, Agent, or Firm*—Fitzpatrick, Cella, Harper & Scinto

[57] ABSTRACT

One of several corona dischargers used in an electrophotographic apparatus is connected to a power source transformer so as to selectively operate these corona dischargers. The power source transformer is provided with a tertiary winding, to which a switching device is connected. When the switching device is turned on, a secondary output from the transformer becomes lower than a corona discharging limit voltage, whereby the corona discharging stops.

11 Claims, 18 Drawing Figures

ELECTROPHOTOGRAPHIC APPARATUS

BACKGROUND OF THE INVENTION

1. Field of the Invention

This invention relates to an electrophotographic apparatus, and, more particularly, it is concerned with an electrophotographic apparatus having a device to control operations of the corona dischargers which are generally used for latent image formation, image transfer, image transfer material separation, and so forth.

2. Description of Prior Arts

In the electrophotographic apparatuses such as electrostatic reproduction apparatus, laser beam printer, and others, there is the necessity for generating corona discharge of both positive and negative polarities in an ordinary condition as will be described later in reference to an actual example, or for stopping the corona discharge in one polarity (e.g., positive polarity) with a certain timing for only a definite period of time, while maintaining generation of the corona discharging in the other polarity (e.g., negative polarity) alone.

FIG. 1 shows a conventionally known electrophotographic apparatus using a photosensitive body of a three-layer structure having an insulative layer on its surface. In FIG. 1, a reference numeral 1 designates a photosensitive layer provided on a metal drum, which consists of three layers, i.e., an electrically conductive substrate, a photoconductive layer, and an insulative layer, as disclosed in U.S. Pat. No. 3,666,363. The photosensitive layer 1 is applied with a voltage of approximately +6.3 kV, uniformly charged by a primary corona discharger to approximately 1,400 V, and then subjected to a charge removing operation by a secondary corona discharger 3, to which a voltage of approximately −6.5 kV is applied, with simultaneous irradiation of an original image light 3*a*. In this consequence, an electrostatic latent image is formed on the surface insulative layer of the photosensitive layer 1 due to the difference in the surface charge density. Subsequently, the entire surface of the photosensitive layer 1 is uniformly exposed by an overall exposure lamp 4 to produce a difference to the surface potential in accordance with brightness of the original image, thereby forming the electrostatic latent image of high image contrast on the insulative layer. In this instance, the surface potential of the photosensitive layer is +500 V at a portion corresponding to a dark portion of the original image, and 0 V at a portion corresponding to a bright portion thereof. Next, toner is adhered onto the electrostatic latent image by means of a developing device 5 to form a visible image on the photosensitive layer 1. This visible image is transferred onto an image transfer paper 7, which has been fed by a paper feeding guide, by the use of a corona charger 8 applied with a voltage of approximately +6.3 kV. The paper which has completed the image transfer operation is separated, and forwarded to an image fixing device (not shown) through conveying rollers 9. On the other hand, the photosensitive layer 1 which has completed the image transfer operation is cleaned by a cleaner 10 to remove the residual toner on the surface of the photosensitive layer 1 for recovery, whereby the above-mentioned reproduction processes can be repeated again.

In the electrophotographic apparatus of the above-mentioned construction, the surface of the photosensitive layer 1 is generally not uniformly charged as diagrammatically illustrated in FIG. 2, immediately after completion of a series of image forming processes. Such condition, if left as it is, would cause an undesirable effect to the subsequent image formation such as, for example, irregularity in the image density, etc. This inconvenience has so far been eliminated by stopping the corona discharging in the primary corona discharger 2 and the image transfer discharger 8 after completion of transfer of the toner image onto the image transfer paper, and, while illuminating light from the lamp 4 onto the photosensitive layer 1 through an open shutter 11 shown in FIG. 1, removing the charge for an appropriate period of time (e.g., during one rotation of the drum) by means of the secondary discharger alone, thereby maintaining the entire surface of the photosensitive layer 1 with a uniform potential of approximately −200 V or so.

In order to carry out such operations, it has heretofore been a practice that two high tension transformers, i.e., one for the primary discharger and the image transfer discharger, and the other for applying a voltage to the secondary discharger, both having mutually different on-off timing, are provided as the transformers $T_1$, $T_2$ in FIGS. 3A and 3B, and, by on-off control of the input voltage to the respective transformers, the operations of the corona dischargers are controlled. With this method, however, two transformers are required, which inevitably leads to increased cost of the apparatus, and an increased size thereof, thus making it unsuitable for the recent trend towards a more reduced size in the electrophotographic apparatus.

It can also be contemplated that a high tension voltage switch is provided at the output side of the high tension power generating device, and, by on-off control of this switch, the operations of the corona dischargers are selectively controlled. In this case, however, there is the danger of the necessity for shutting the high tension voltage circuit during the operations for which a switch of high voltage durability is required, which disadvantageously increases the cost of the apparatus.

SUMMARY OF THE INVENTION

It is an object of the present invention to provide an electrophotographic apparatus which performs on-off control of the corona discharging function by lowering a voltage to be supplied to the corona dischargers below a corona discharging limit voltage.

It is another object of the present invention to provide an electrophotographic apparatus capable of readily performing selective on-off controls of a plurality of corona dischargers having different operational timings and being connected to one high tension power generating device.

It is still another object of the present invention to provide an electrophotographic apparatus capable of readily changing over the operations of the corona dischargers at the time of image formation and the time of non-image formation.

It is yet another object of the present invention to provide an electrophotographic apparatus capable of easily performing the on-off controls of the corona dischargers for separating the image transfer material.

According to the present invention, generally speaking, there is provided an electrophotographic apparatus which comprises: voltage transforming means having a primary winding, to which an input power source voltage is applied, and a secondary winding having taps to produce outputs to a plurality of corona dischargers; an additional, tertiary winding provided in the voltage transforming means; and a high tension power generating device having a switching means connected to the tertiary winding, to reduce an output voltage from the secondary winding below a corona discharging limit voltage.

With the above-described construction, the present invention is capable of reducing an output voltage from the secondary winding below a corona discharging start voltage (hereinafter called "discharging limit voltage"), and stopping the corona discharging. Further, the corona dischargers are selectively operated by reducing the voltage in one polarity below this discharging limit voltage, and maintaining the voltage in another polarity at such a voltage level that the function of the corona discharge can be kept as it is. Accordingly, the on-off control of the corona dischargers can be selectively performed with a simple construction.

The foregoing and other objects, as well as the characteristic features of the present invention will become more apparent from the following detailed explanations thereof when read in conjunction with the accompanying drawing.

DETAILED DESCRIPTION OF PREFERRED EMBODIMENTS

In the following, preferred embodiments of the present invention will be explained in reference to the accompanying drawing.

Figure 4:
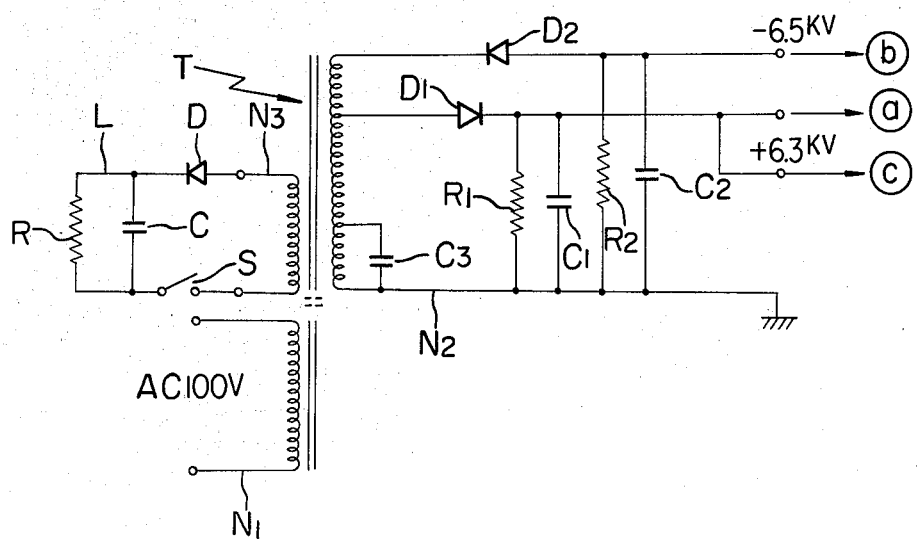
FIG. 4 is a circuit diagram of a high tension power generating device which is one embodiment of the present invention.

FIG. 4 is a circuit diagram showing one embodiment of the high tension power generating device according to the present invention. Incidentally, it should be noted that the explanations throughout this specification will be made on the electrophotographic apparatus shown in FIG. 1, in which this high tension power generating device has been incorporated.

A high tension transformer T in FIG. 4 has a tertiary winding $N_3$, to which there are connected a load circuit L consisting of a diode D, a resistor R, and a capacitor C, and switching means having a switch S. In normal operations, the switch S remains open, an output from the secondary winding $N_2$ generates outputs in positive (+) and negative (−) polarities which are introduced into each of the chargers in FIG. 1 through lead wires a , b , and c , whereby the latent image formation, image transfer, etc. are effected. At this time, an output voltage from the tertiary winding in its load-free state is approximately 50 V. As soon as the last sheet of image transfer paper completes its image transfer operation, the switch S is closed by the operational timing, and a load in the negative polarity (−) is applied to the tertiary winding just as for the secondary winding output. The transformer used is so constructed that the primary winding $N_1$, the secondary winding $N_2$, and the tertiary winding $N_3$ are bound by a leakage magnetic flux, hence the positive (+) high tension output at the secondary side becomes relatively lowered. The output at the negative side (−) is maintained substantially constant, although it might slightly lower.

In the drawing, reference symbols $D_1$, $D_2$ at the secondary output side refer to diodes for half-wave rectification, $C_1$, $C_2$ refer to capacitors for reducing ripple current, $R_1$, $R_2$ resistors for obtaining outputs, and $C_3$ a resonant capacitor which is inserted to keep fluctuations in the output to the minimum with respect to input fluctuations.

Figure 5:
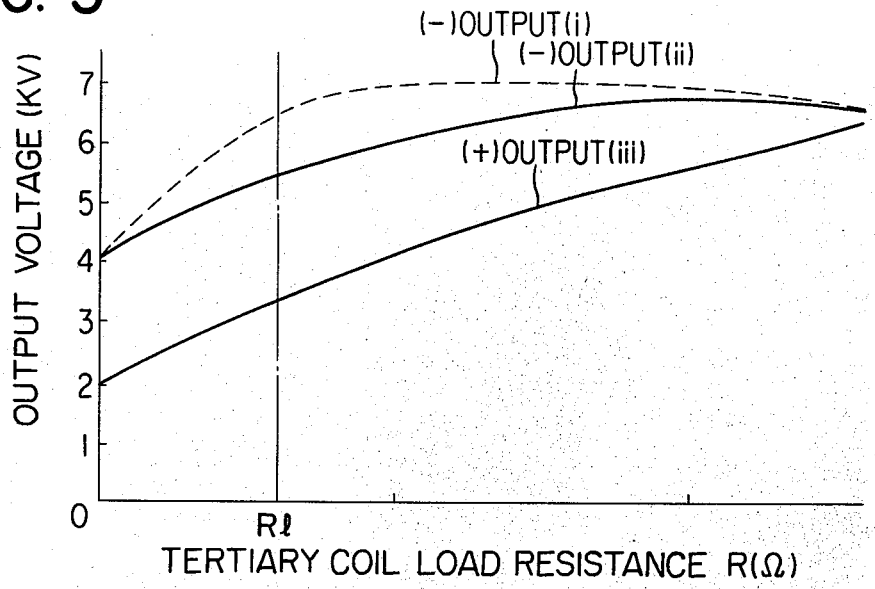
FIG. 5 is a graphical representation showing the corona discharging characteristics according to the present invention.

The positive output (+) and the negative output (−) at the abovementioned timing depend on the magnitude of the load resistor R. FIG. 5 represents an outline of the characteristics when the secondary output is measured by varying this load resistor R. In the drawing, the ordinate denotes an output voltage (kV) in its absolute value. Curves (i) and (ii) of the output (−) are due to differences in the structure of the transformers, in which the curve (i) shows a case of the transformer being in a substantially ideal construction. Rl denotes a value of the load resistor R when the positive output (+) in curve (iii) becomes lower than the discharging limit voltage, the value being determined by various conditions such as performance of the transformer, and so forth. In other words, in order to stop the corona discharging from the primary corona discharger and the image transfer discharger, the voltage to be applied to these dischargers need not be made 0 V.

Figure 6A:
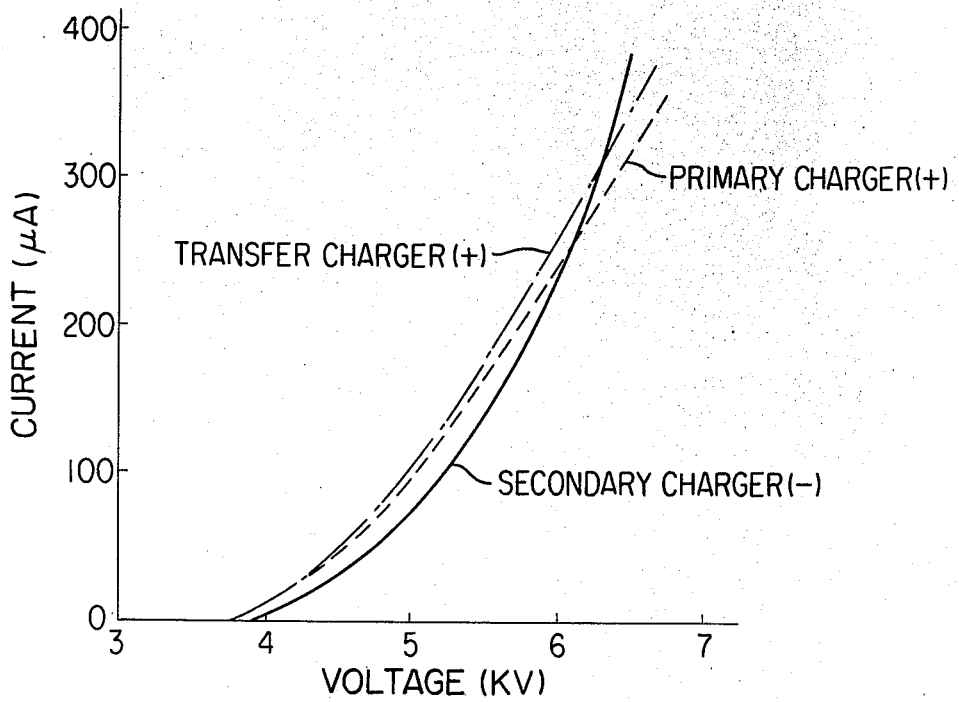
FIG. 6A is a graphical representation showing voltage versus current characteristics of the corona dischargers.
Figure 6B:
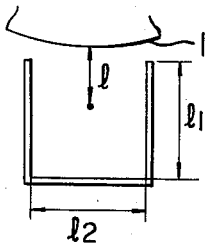
FIGS. 6B and 6C are cross-sectional views showing the shape of the corona dischargers used for the purpose of plotting the graphs in FIG. 6A.
Figure 6C:
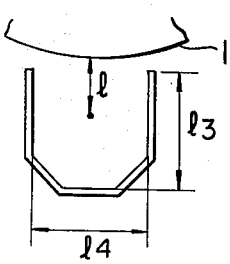

FIG. 6A shows voltage versus current characteristics of the respective corona dischargers. FIGS. 6B and 6C illustrate cross-sectional shapes of the primary corona discharger and the image transfer discharger used for the experiments, wherein FIG. 6B shows the shape of the primary discharger, and FIG. 6C shows the shape of the image transfer discharger. The size of the dischargers as measured are $l_1=l_2=l_3=l_4=20$ mm, and a distance l between the discharging wires and the photosensitive layer is $l=9.5$ mm.

As is apparent from FIG. 6A, the discharging limit voltages of the two dischargers are approximately 3.5 to 3.7 kV. Accordingly, when the voltage becomes lower than 3.5 kV, the corona discharging can be stopped. As a consequence of this, when the load resistance R is selected at the value of Rl in FIG. 5, for example, the primary and image transfer dischargers no longer generate corona. On the other hand, an ideal voltage to be applied to the secondary discharger (−) is as shown by the curve (i) in FIG. 5, because there can be obtained an output which is at the same level as in the ordinary condition (approximately −6.5 kV). However, even when the output decreases to some extent (approximately −5.5 kV) when the load resistance is Rl as in the curve (ii), the dischargers retain sufficient capability of averaging the surface potential of the photosensitive body. Thus, according to the present invention, the transformer to be used may be essentially single, and the on-off controls of the corona discharge at the positive (+) side alone can be carried out with the switching means of the tertiary winding in a simple construction. As a result, the corona discharge control can be attained by the high tension power generating device of a simple construction and low manufacturing cost.

Incidentally, in the graphical representation of FIG. 6A, the applied voltage (kV) is denoted in the abscissa, and the discharge current (μA) in the ordinate, in terms of their respective absolute values.

Figure 1:
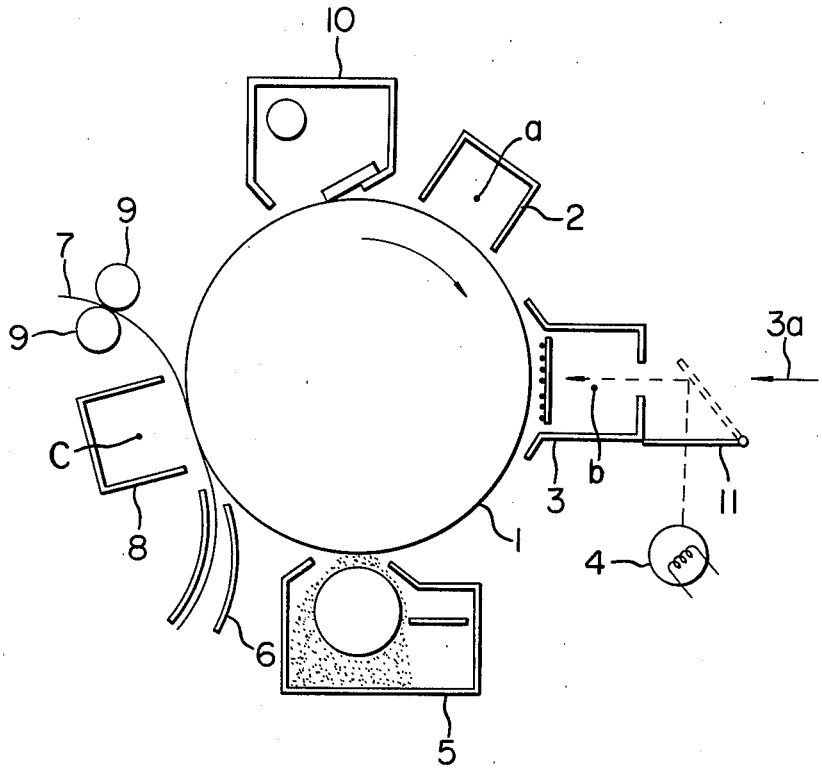
FIG. 1 PRIOR ART
FIGS. 1 to 3B are explanatory diagrams showing the conventional electrophotographic apparatus.
Figure 7:
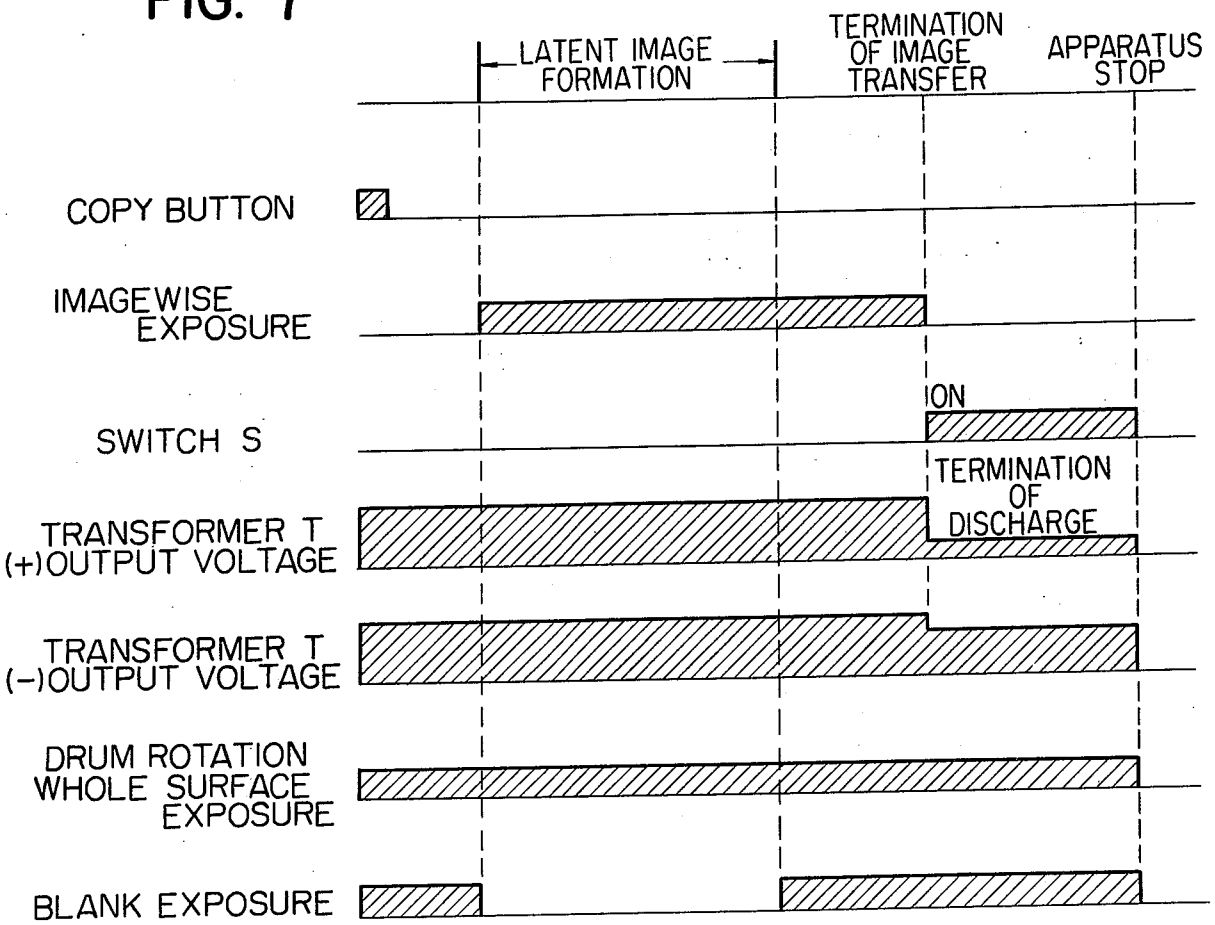
FIG. 7 is a timing chart showing a sequence of operations of the electrophotographic apparatus using the high tension power generating device of FIG. 4.

FIG. 7 is a timing chart for carrying out the charge removing operation on the photosensitive body of the electrophotographic apparatus shown in FIG. 1 using the high tension power generating device according to the present invention. In the drawing, the switch S is closed by the control means after the last image transfer operation, i.e., the image formation on the photosensitive body, has been terminated. By this switch-on, current in the positive (+) polarity is consumed in the load circuit L shown in FIG. 4, a positive (+) output voltage from the secondary winding $N_2$ of the transformer T becomes lower than the discharging limit voltage, and the primary and image transfer corona dischargers stop discharging.

By this simple control method using the small-sized, low cost high tension power generating device, the potential distribution on the surface of the photosensitive body can be made uniform, whereby any undersirable effect such as irregularity in the charge removal, etc. to the subsequent image formation can be prevented. Moreover, since it is not necessary to provide a corona discharger and a transformer exclusively for the charge removal, the device as a whole becomes very simple. Also, since no high tension switch is used in this device, there exists the least possibility of danger in operating the device, which is advantageous.

Figure 2:
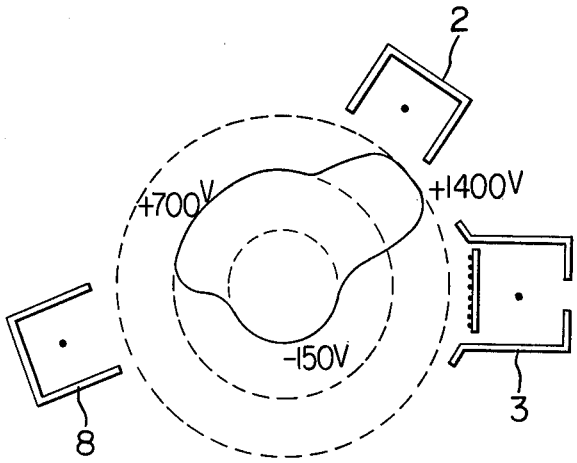
FIG. 2 PRIOR ART
Figure 8:
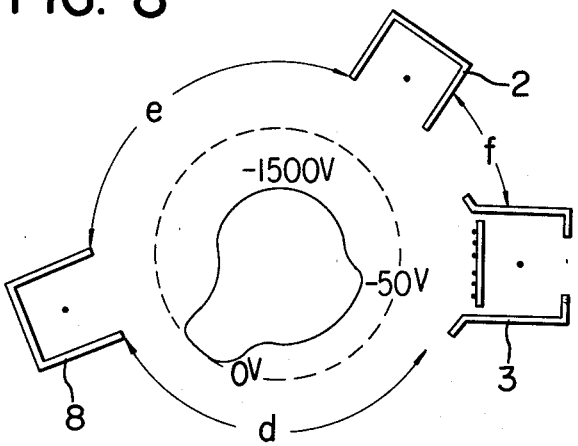
FIGS. 8 and 9 are explanatory views showing the state of the surface potential of the photosensitive body, in which the present invention is applied.
Figure 9:
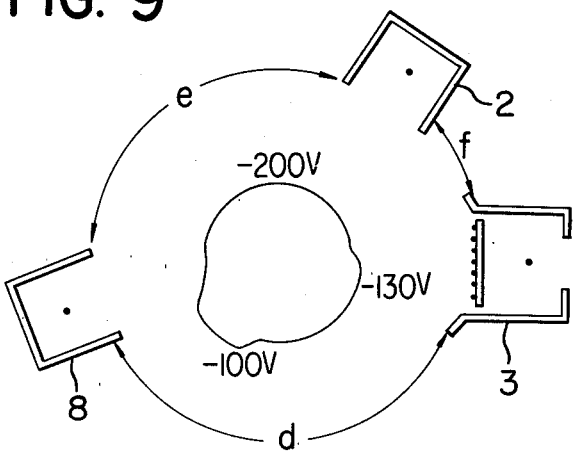

FIGS. 8 and 9 show the states of the surface potential on the photosensitive body when the charge removal from the photosensitive body is effected in the operational sequence as shown in FIG. 7 with the high tension power generating device of FIG. 4 being incorporated in the electrophotographic apparatus of FIG. 1. FIG. 8 indicates the potential distribution immediately after completion of the image transfer operation, in which the secondary corona discharger 3 alone acts upon the photosensitive layer having the potential distribution as shown in FIG. 2 by closure of the switch S connected to the tertiary winding of FIG. 4, and then the photosensitive drum is subjected to approximately half a rotation. FIG. 9 shows the potential distribution after the photosensitive drum has been further rotated for one full rotation. In this manner, the potential can be maintained substantially uniform, and almost no marked non-uniformity in the image density can be recognized at the subsequent use, even if the drum is left unused over a long period of time. Even in FIG. 9, there still exists non-uniformity in the surface potential to some extent. Such non-uniformity in the potential distribution can be more improved by another rotation of the photosensitive drum. In this case, however, the surface potential lowers to a level near −300 V, and, when the photosensitive layer is brought to such a low potential level, the electrostatic latent image potential at subsequent use becomes too low to obtain, in most cases, a satisfactory image of sufficiently high image contrast. In order to avoid this, after the potential distribution has been set as shown in FIG. 8, the voltage to be applied to the secondary corona discharger 3 is further reduced, and the photosensitive drum is subjected to one or two rotations in the state of the charge removing capability being lowered, thus there can be obtained a substantially uiform potential distribution of −200 V or so.

Figure 10:
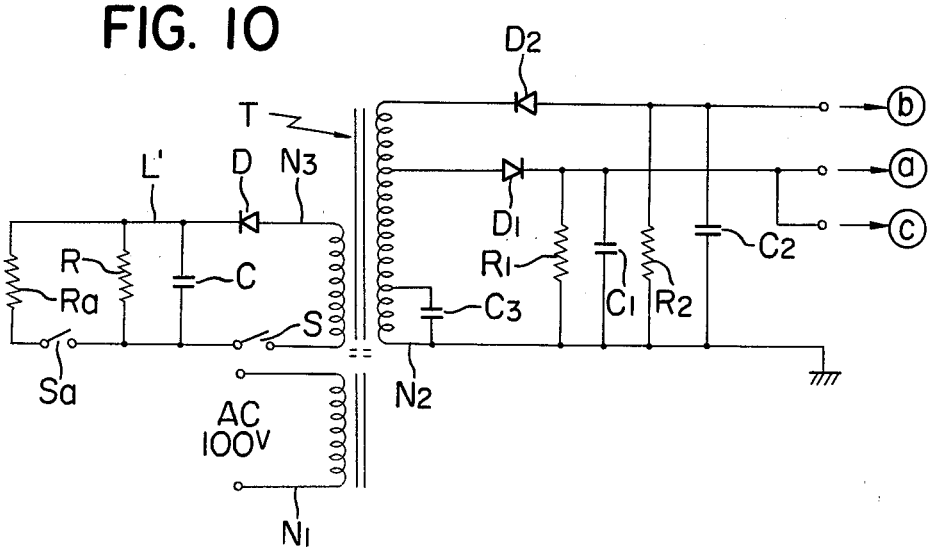
FIG. 10 is a circuit diagram of the high tension power generating device which is another embodiment of the present invention.

FIG. 10 shows a circuit diagram showing one example of change-over of such applying voltage. In this circuit construction, a load Ra is inserted in parallel with the load resistor R of the load circuit L in FIG. 4, and a switch Sa in series with the load Ra, the value of the composite load resistance is made small, and the current flowing through a load circuit L′ is made large, so that the voltage to be applied to the secondary corona discharger may be lowered.

Figure 11:
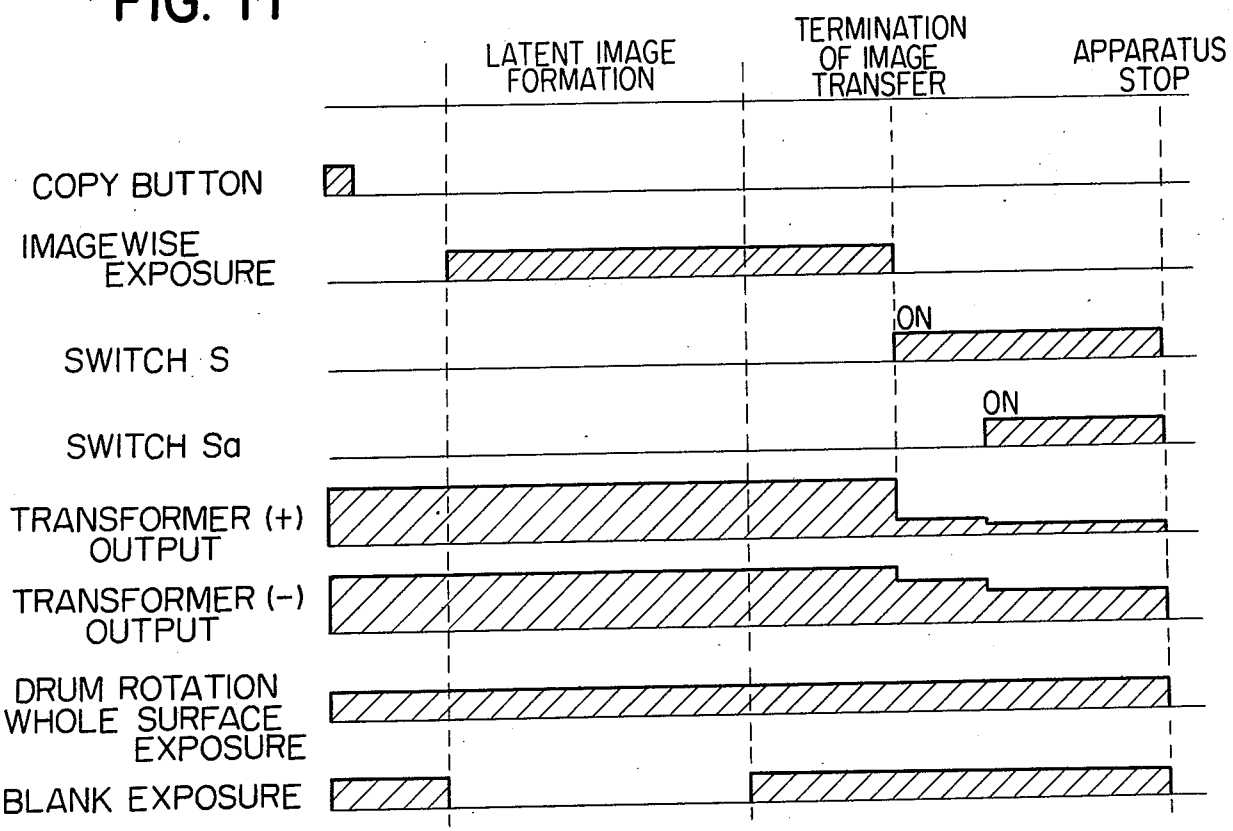
FIG. 11 is a timing chart of the electrophotographic apparatus, to which the circuitry of FIG. 10 is applied.

FIG. 11 shows a timing chart of the electrophotographic apparatus having the high tension power generating device according to the circuit shown in FIG. 10. As seen from the chart, the switch S is closed, after completion of the image transfer operation, to subject the photosensitive body to a half or full rotation, then the switch Sa is closed to further reduce a negative output from the transformer T, i.e., a voltage to be applied to the secondary corona discharger, thereby converging the potential on the surface of the photosensitive body to a substantially uniform value of −200 V or so. At this time, the positive output from the transformer T is below the corona discharging limit voltage, hence no corona discharging is done.

In the explanation of the embodiments according to the present invention, a positive (+) voltage is applied to the primary corona discharger, and a negative voltage (−) is applied to the secondary corona discharger, as an example. It should, however, be noted that the polarity of the voltage to be applied to each of the corona dischargers may be opposite to the above. Also, in the case of a.c. voltage being applied to the secondary corona discharger, the primary and image transfer corona dischargers may be turned off to perform the operations of the charge removal from the photosensitive body, and so forth. In this instance, the abovementioned a.c. voltage may be a bias a.c. voltage, to which a bias voltage has been imparted. Besides the embodiments shown, it is possible to combine other corona dischargers such as the corona discharger for charge-removing from the photosensitive body, etc.. Furthermore, besides the electrophotographic apparatus using the three-layered photosensitive body as mentioned above, the high tension power generating device according to the present invention is also applicable to the xerographic method, as described in U.S. Pat. No. 2,297,691, which uses a photosensitive member with a photoconductive insulating material being provided on the surface of the electrically conductive body.

Figure 12A:
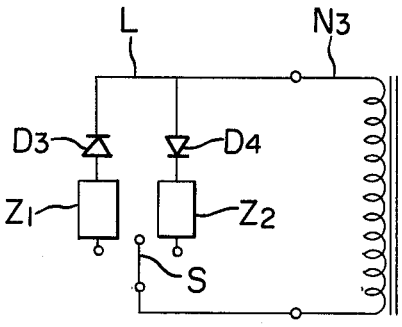
FIGS. 12A and 12B are partial circuit diagrams of the high tension power generating device which are other embodiments of the present invention.
Figure 12B:
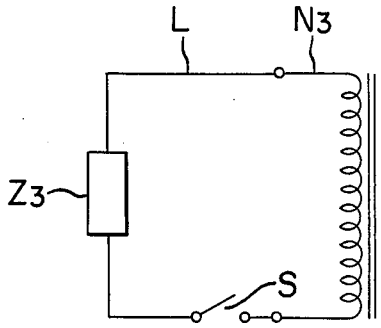

Further, in the explanations of the above embodiments, there has been given an example, wherein the charge removal of the photosensitive body is effected by stopping operation of the corona discharger in one polarity through the on-off controls of the switch S in FIG. 4, while continuing only the operation of the corona discharger of the other polarity. Besides this, it is possible to construct the device as shown in FIG. 12A which is a circuit diagram of only the tertiary winding, wherein rectifying elements $D_3$, $D_4$ having mutually opposite polarities are connected in series with impedance elements or load elements $Z_1$, $Z_2$ which render the secondary output lower than the corona discharging limit voltage. By change-over of the switch S, either or both of the positive (+) and negative (−) corona dischargers can be selectively operated. It is also possible that, as shown in FIG. 12B, the secondary output is reduced below the corona discharging limit voltage, and the operations of the entire corona dischargers are stopped by insertion of an impedance element or a load element $Z_3$ into the load circuit L, and by closure of the switch S.

Figure 13:
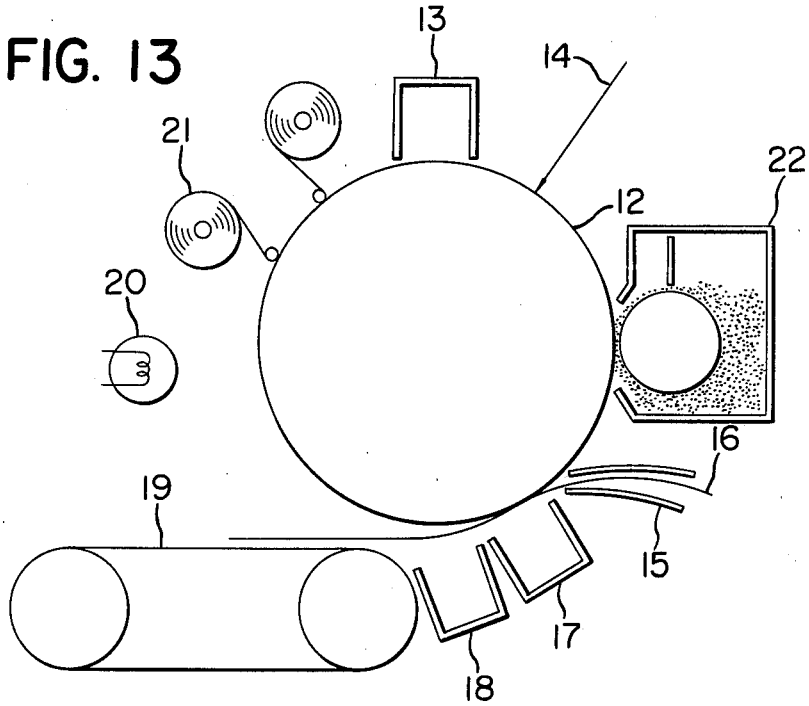
FIG. 13 is an explanatory diagram showing still other embodiment of the present invention.

In the following, another embodiment of the present invention will be described in reference to FIG. 13 showing a part of the electrophotographic apparatus, in which the high tension power generating device of the present invention is incorporated. In FIG. 13, a reference numeral 12 designates a photosensitive drum according to the xerographic method, wherein a photoconductive material is coated on a metal cylinder. The photosensitive drum is uniformly charged by a corona discharger 13. After the charging, the original image is irradiated onto the drum surface in an arrow direction 14, whereby an electrostatic latent image is formed. Further, the toner is adhered onto the latent image by means of a developing device 22. Then, a corona discharge, applied by charger 17, in the polarity opposite that of the toner, i.e., the same polarity as that of the primary charge 13, is imparted to an image transfer paper 16 which has been forwarded through an image transfer paper guide 15, thereby carrying out the corona image transfer. A numeral 18 refers to a separating charger for separating the image transfer paper from the photosensitive drum. By imparting a corona charge in the polarity opposite that of the image transfer charge to the image transfer paper, the electrostatic absorptive force between the photosensitive drum and the image transfer paper due to the image transfer charge is reduced, thereby smoothly separating the image transfer paper 16 from the photosensitive drum 12. However, if the separation charging is effected continuously and vigorously at this time, there takes place a reversed image transfer of the toner image to the photosensitive drum to cause the image quality of the reproduced image to be inferior. In order to avoid this, a charging in the polarity opposite that of the image transfer charging is effected at only the tip end of the image transfer paper for smooth separation of the paper, which is disclosed in Japanese patent publication No. 53-17495 (corresponding to U.S. Pat. application Ser. No. 335,967).

Figure 3A:
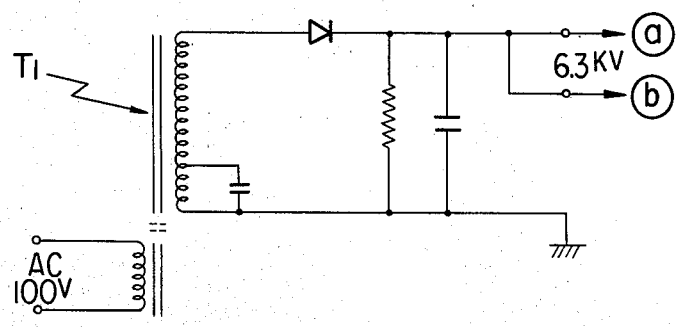
FIG. 3A PRIOR ART
Figure 3B:
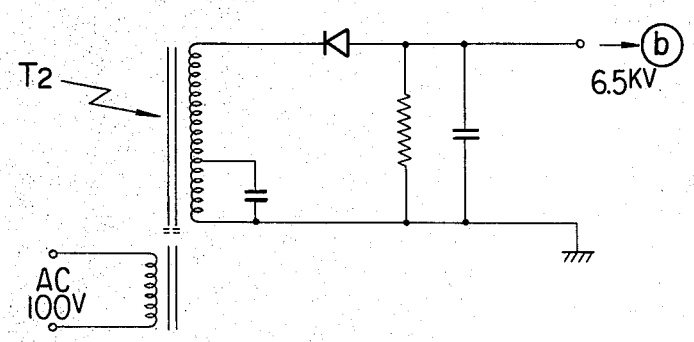
FIG. 3B PRIOR ART
Figure 14:
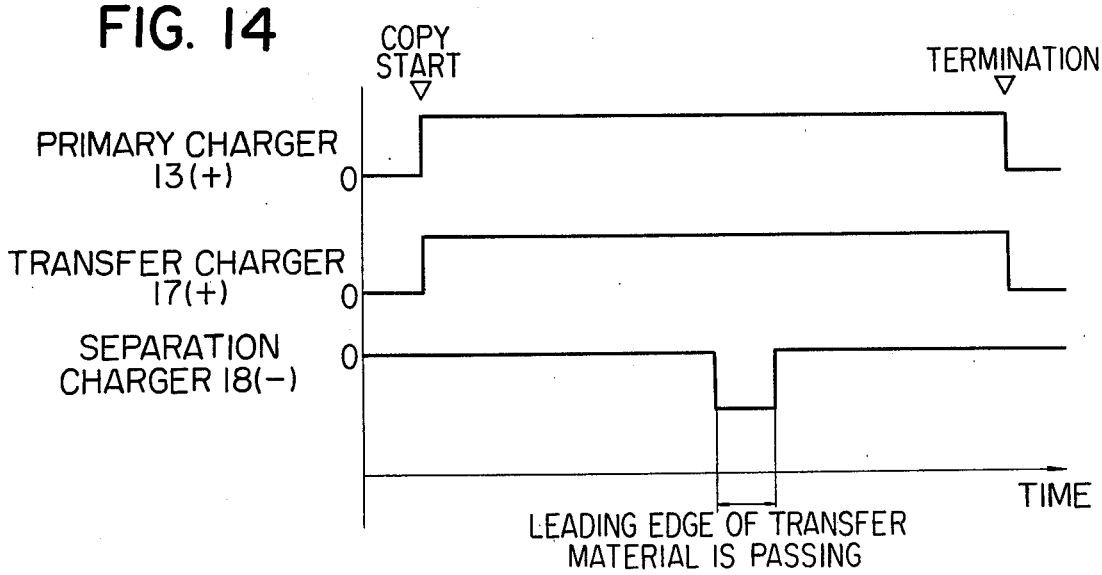
FIG. 14 is a timing chart showing the timing for applying a voltage to each of the dischargers.

In this case, each of the chargers is required to operate with the timing as shown in FIG. 14, for which purpose two transformers as shown in FIG. 3 are usually necessary. According to the present invention, however, the desired operation can be done with a single transformer. In more detail, a transformer having the tertiary winding and switching means as shown in FIG. 4 is used, and the diode D in the load circuit of the tertiary winding is oriented in the opposite directions, whereupon there can be obtained, as the characteristic of the transformer, the characteristics, in which the polarities, i.e., positive and negative, in FIG. 5 have been reversed. Accordingly, in the ordinary condition (other than when the tip end of the image transfer paper is at the position of the separating charger 18), when the switch S is closed, the applying voltage to the separating charger becomes lower than the corona discharging limit voltage, and no corona discharging is effected. When the tip end of the image transfer paper 16 has arrived at the position of the separating charger and the switch S is opened, a negative applying voltage is imparted to the separating charger 18, and the charge removal from the image transfer paper is effected, whereby the tip end of the paper is separated. After lapse of a definite time, when the switch S is closed again, the negative applying voltage becomes lower than the discharging limit voltage of the separating charger 18, whereby the corona discharging stops again.

A reference numeral 19 in FIG. 13 designates an image transfer paper conveying device, 20 refers to a lamp for charge removal and fatigue recovery, and 21 a cleaning member in a web form.

In the embodiments according to the present invention, the load circuit in the tertiary winding is not limited to one having the diode as shown in FIGS. 4 and 10, but various forms such as those using other rectifying elements and active elements such as transistors, etc. are applicable.

As stated in the foregoing, in the device having a corona discharger, to which a positive voltage is applied, and a corona discharger, to which a negative voltage is applied, or a discharger, to which a.c. voltage has been applied, when the corona discharge in one polarity alone is to be stopped for a certain time period, the present invention makes it possible to provide an electrophotographic apparatus having the high tension power generating device in compact size and low manufacturing cost, whereby effective corona discharge control can be achieved.

What is claimed is:

1. A high voltage generating device which supplies electric voltage to corona dischargers in an electrophotographic apparatus, comprising:
   (a) a primary winding, to which an input power source voltage is applied;
   (b) a secondary winding having taps for providing voltage outputs to corona dischargers of a specific polarity and the opposite polarity;
   (c) a tertiary winding; and
   (d) switching means connected to said tertiary winding, for lowering the secondary output voltage of a specific polarity below a corona discharging limit voltage.

2. The device as set forth in claim 1, wherein said switching means lowers only the secondary output voltage of a particular polarity below the corona discharging limit voltage.

3. The device as set forth in claim 1, wherein said switching means selectively lowers the secondary output voltage of a specific polarity or of the opposite polarity below the corona discharging limit voltage.

4. The device as set forth in claim 1, wherein all the secondary outputs of the specific polarity and of the opposite polarity become lower than the corona discharging limit voltage when said switching means is actuated.

5. The device as set forth in claim 1, wherein said switching means has a load circuit.

6. The device as set forth in claim 5, wherein said load circuit has a rectifying element.

7. The device as set forth in claim 5, wherein said load circuit has a switch.

8. The device as set forth in claim 5, wherein said load circuit is so constructed that a value of the load can be changed over so that an output voltage to a corona discharger may be changed, while an output voltage to another said corona discharger of a specific polarity is being maintained lower than the corona discharging limit voltage.

9. The device as set forth in claim 1, wherein a plurality of corona dischargers, each having different operational timing, are connected to said high voltage generating device.

10. An electrophotographic apparatus, comprising:

(a) a three-layered photosensitive body consisting essentially of an insulating layer, a photoconductive layer, and an electrically conductive substrate;

(b) means for substantially applying primary corona charging to said photosensitive body;

(c) secondary corona discharging means for applying corona discharge in a polarity opposite that of said primary charge or a.c. corona discharge, said secondary corona discharge being effected in conjunction with irradiation of an original image light;

(d) means for subsequently uniformly irradiating light onto the surface of the photosensitive body thereby completing the formation of an electrostatic image thereon;

(e) means for developing said electrostatic image on said photosensitive body (f) means for transferring the developed image onto an image transfer material with a corona discharge of the same polarity as that of the primary corona charge;

(g) a high voltage generating means for supplying voltages to said corona discharger means, said high voltage generating means including a primary winding to which an input power source voltage is applied, a secondary winding having taps for providing voltage outputs of a specific polarity and an opposite polarity to the respective corona discharger means, a tertiary winding, and switching means connected to said tertiary winding in order to lower an output voltage of a specific polarity from said secondary winding below a corona discharging limit voltage; and (h) means for controlling operations of said switching means when the image is formed, and when the image is not formed.

11. An electrophotographic apparatus, comprising:

(a) a rotatable photoconductive member;

(b) means for forming an electrostatic latent image on said photoconductive member;

(c) means for developing the electrostatic latent image;

(d) means for transferring the developed image onto an image transfer material by means of a corona discharger;

(e) means for separating the image transfer material from the surface of the photoconductive member by means of the corona discharger, wherein said transfer material is conveyed through said apparatus;

(f) high voltage generating means for supplying voltages to said corona discharger means, said high voltage generating means including a primary winding to which an input power source voltage is applied, a secondary winding having taps for providing voltage outputs of a specific polarity and an opposite polarity to the respective corona discharger means, a tertiary winding, and switching means connected to said tertiary winding in order to lower an output voltage of said specific polarity from said secondary winding below a corona discharging limit voltage; and (g) means for controlling operations of said switching means in response to conveyance of the image transfer material.

* * * * *